United States Patent [19]

Arvidsson et al.

[11] 4,335,784

[45] Jun. 22, 1982

[54] SEALING DEVICE IN A ROTARY REGENERATIVE TYPE HEAT EXCHANGER

[76] Inventors: Willy B. L. Arvidsson, Sven Baelters väg 24, Växjö, Sweden; Anders S. G. Lindgren, Vikingagatan 20, Växjö, Sweden

[21] Appl. No.: 136,240

[22] Filed: Apr. 1, 1980

[51] Int. Cl.[3] ..... F28D 19/00

[52] U.S. Cl. ..... 165/9; 277/56

[58] Field of Search ..... 165/9; 277/56, 57

[56] References Cited

U.S. PATENT DOCUMENTS

| | | | |
|---|---|---|---|
| 1,925,898 | 9/1933 | Fritz | 277/56 X |
| 2,743,945 | 5/1956 | Bentele et al. | 165/9 X |
| 3,416,509 | 12/1968 | Huebler et al. | 126/21 A |

FOREIGN PATENT DOCUMENTS

| | | | |
|---|---|---|---|
| 52-74149 | 6/1977 | Japan | 165/9 |

*Primary Examiner*—Albert W. Davis

[57] ABSTRACT

The present invention relates to a sealing device for minimizing leakage losses in a rotary regenerative type heat exchanger, and more particularly in a heat exchanger comprising a cylindrical matrix of heat absorbent material rotatably mounted in a stationary housing.

To prevent a loss of efficiency of the heat exchanger, which occurs when an uncontrolled flow between the inlets and the outlets of the exchanger takes place, an axially extending annular groove (3) having bottom and side walls is formed in each of the two end surfaces (2) of the matrix (1). In each of these annular grooves (3) a stationary sealing sleeve (5) projects into each of said grooves.

1 Claim, 1 Drawing Figure

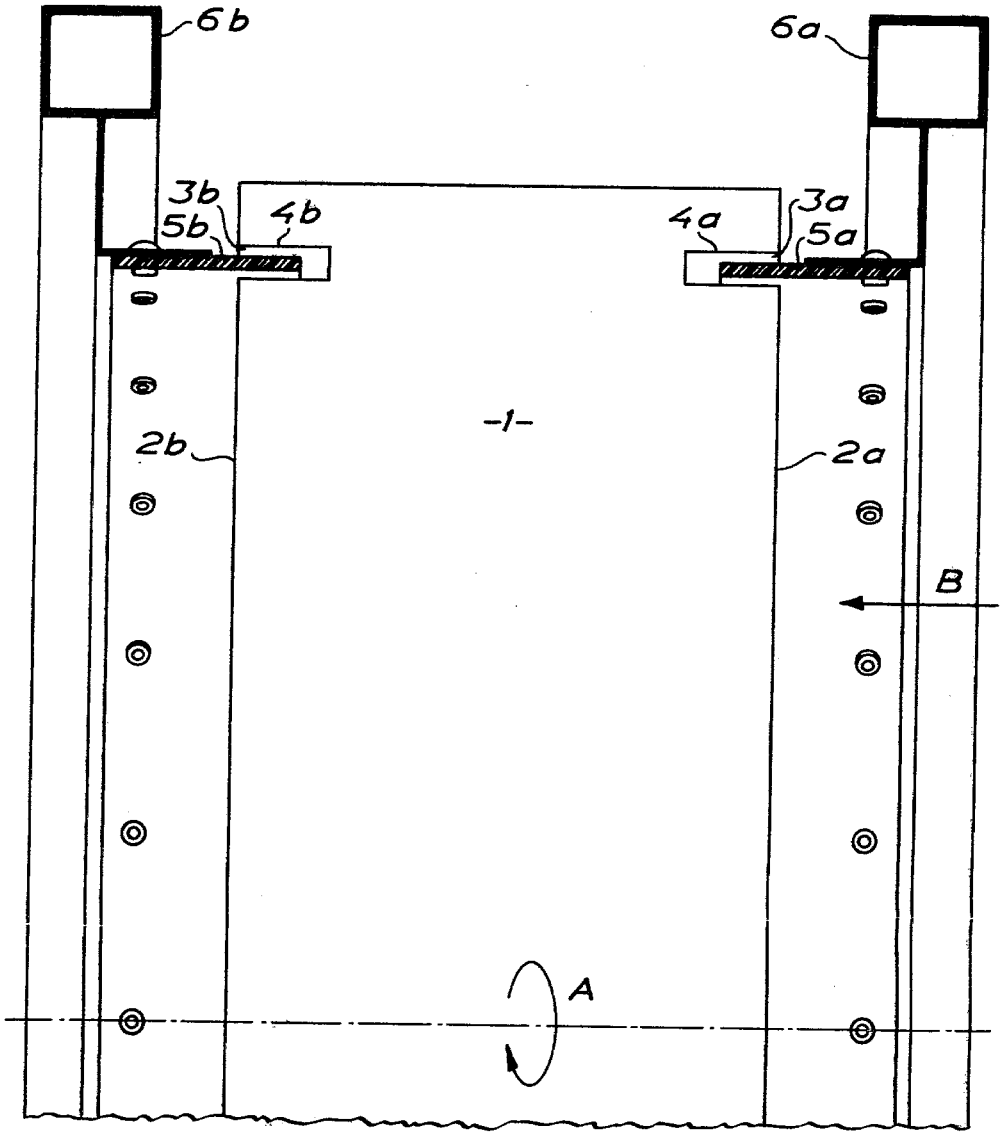
6b
6a
3b
5b
4b
4a
3a
5a
-1-
2b
2a
B
A

SEALING DEVICE IN A ROTARY REGENERATIVE TYPE HEAT EXCHANGER

The present invention relates to a sealing device for minimizing leakage losses in a rotary regenerative type heat exchanger and more particularly in a heat exchanger comprising a cylindrical matrix of heat-absorbent material rotatably mounted in a stationary housing.

In heat exchangers of the kind referred to a fluid flows through one portion of the cylindrical matrix to emit or absorb heat while another fluid flows through another portion of the matrix to absorb and emit heat, respectively. The matrix of heat-absorbent material absorbs or emits heat in said first mentioned portion of the matrix during the flow of fluid therethrough and emits or absorbs heat during the flow of fluid through said other portion of the matrix. This heat transfer takes place during the continuous rotation of the matrix. Heat exchangers of this type frequently use air as heat-transferring medium. Thus, the heat exchanger will provide a certain amount of resistance to the air-flow. This means that a higher pressure will exist at the separate inlets of the heat exchanger compared with the pressure existing at the outlets thereof. To prevent a loss of efficiency of the heat exchanger measures must be taken to avoid a flow of air between the inlets and the outlets of the exchanger in another way than through the very matrix. The matrix is usually formed by a helically wound corrugated stripe material with intermediate spacers, e.g. consisting of aluminum foil the flow passages being formed by the corrugations of said stripe material. Quite often, the cylindrical matrix has an axial misalignment which makes more difficult to seal the inlets and the outlets of the heat exchanger.

In order to provide a seal between said inlets and outlets the use of annular felt packings or packings consisting of a heat-resistant material and bearing against the peripheral end surfaces of the matrix has been proposed. Although these felt packings are made resilient there is still a risk that the packings eventually cannot provide an adequate sealing effect during a full revolution of the matrix. Thus, an undesirable leakage will occur between the inlets and the outlets of the heat exchanger.

The primary object of the invention is to provide a sealing device for heat exchangers of the kind referred to above, which provides an effective sealing between the inlets and the outlets of the heat exchanger.

A further object of the invention is to provide a sealing device for heat exchangers of the kind referred to above, which is not exposed to great bearing forces and yet provides an effective sealing.

Additional objects and advantages of the invention in part will be set forth in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, there is provided, according to the invention, in a sealing device for a heat exchanger of the kind referred to above the improvement wherein an axially extending angular groove having bottom and side walls is formed in each of the two end surfaces of the matrix a stationary sealing sleeve projecting into each of said grooves.

Preferably, the free edge of each sealing sleeve is spaced from the bottom of the associated groove, so that a sealing effect can be obtained without any distortion of the sleeve.

It is also preferred that the width of the sealing sleeves is less than the width of the associated annular grooves. Thus, when using elastic or resilient sealing sleeves, a sufficient sealing effect can be achieved at minimum frictional forces between the sealing sleeves and the sidewalls of the associated annular grooves.

The invention will be described in more detail below with reference to the accompanying drawing which illustrates a preferred embodiment of the invention.

The single FIGURE in the drawing is an axial cross sectional view of one half of a heat exchanger equipped with a sealing device according to the invention.

The heat exchanger comprises a cylindrical matrix 1 mounted in a stationary housing (not shown) for rotation about an axis indicated by the dot and dash line in the drawing. The matrix can be of any suitable structure, known in the art, which forms through axial fluid passages between the end surfaces 2*a* and 2*b* of the matrix. Axially extending circumferential annular grooves 3*a*, 3*b* are arranged in the two end surfaces 2*a*, 2*b* close to the periphery of the matrix 1. Said annular grooves are lined with mouldings 4*a*, 4*b* forming level bottom and side walls in the grooves.

A sealing sleeve 5*a* and 5*b*, respectively, supported by a stationary rack 6*a* and 6*b*, respectively, projects into each of said annular grooves 3. Each sleeve connects to a gas conduit (not shown) for passing gas, such as air, through the matrix. If the gas flow is in the direction indicated by the arrow B, sleeve 5*a* forms an inlet and sleeve 5*b* an outlet for the gas. The sleeves should be made of a resilient or elastic material such as needle felt material, synthetic rubber or resin material. When the matrix is rotated about said axis in the direction of the arrow A, the sealing device according to the invention can put up with an axial misalignment of the matrix and yet maintain a sealing effect at the inlets and the outlets of the heat exchanger.

The annular grooves 3 are formed subsequent to the manufacture of the matrix 1. This means that the annular grooves can have a uniform radius from the rotational axes of the matrix.

The sealing device according to the invention provides a proper sealing effect independently of the gas flow direction. If the inlet side is represented by the end surface 2*a* as indicated by arrow B, i.e. there is a higher pressure at this side than at the end surface 2*b*, thus representing the outlet side, sealing is obtained between the sealing sleeve 5*a* and the annular groove 3*a* either by the throttling effect afforded by the clearance between the sealing sleeve and the side walls of the annular groove or, at a higher differential pressure between the inlet and the outlet, by contact of the resilient or elastic sealing sleeve 5*a* with the outer side wall of the annular groove 3*a*. Accordingly, the sealing sleeve 5 will bear against one of the side walls of the annular groove 3 when it is acted upon by the differential pressure existing between the inlet and the outlet of the heat exchanger.

A gas flow usually an air flow in the direction of arrow B will deliver heat to the matrix 1 in the upper half thereof when passing through the matrix, and a corresponding gas or air flow in the opposite direction through the lower half of the matrix 1 will absorb said heat from the matrix 1 when passing therethrough. As will be appreciated, the sealing sleeve 5*a* bearing against the outer side wall of the annular groove 3 in the upper half of the heat exchanger shown in the drawing, will bear against the inner side wall of the annular groove 3 in the lower half of the heat exchanger due to the reversed flow direction therein.

The invention is not limited to the embodiment shown and described; modifications can be made within the scope of the following claims.

We claim:

1. A sealing device in a rotary regenerative-type heat exchanger comprising a cylindrical matrix of heat-absorbent material rotatably mounted in a stationary housing; two axially extending annular grooves having bottom and side walls, one formed in each one of the end surfaces of the matrix; two stationary resilient sealing sleeves each one projecting into one of said grooves and resiliently bearing against one of the side walls of the associated annular groove under differential fluid pressure applied to one side of the sleeve; the free edge of each sealing sleeve being spaced from the bottom of the associated groove; and the width of the sealing sleeves being less than the width of the associated annular groove.

* * * * *